United States Patent [19]

Mori et al.

[11] Patent Number: 4,586,558

[45] Date of Patent: May 6, 1986

[54] STRUCTURE OF FEED NOZZLE UNIT FOR HORIZONTAL CONTINUOUS CASTING PROCESS

[75] Inventors: Takasuke Mori, Hyogo; Jun Miyazaki, Kobe; Manabu Miyamoto, Kobe; Kiichi Narita, Kobe, all of Japan

[73] Assignee: Kabushiki Kaisha Kobe Seiko Sho, Kobe, Japan

[21] Appl. No.: 571,693

[22] Filed: Jan. 18, 1984

[30] Foreign Application Priority Data

Jan. 18, 1983 [JP] Japan ..... 58-5919[U]

[51] Int. Cl.[4] ..... B22D 11/10

[52] U.S. Cl. ..... 164/440; 222/591

[58] Field of Search ..... 164/418, 440, 490; 222/591, 590

[56] References Cited

FOREIGN PATENT DOCUMENTS 2202134 3/1972 Fed. Rep. of Germany ..... 164/440

*Primary Examiner*—Nicholas P. Godici

*Assistant Examiner*—G. M. Reid

*Attorney, Agent, or Firm*—Oblon, Fisher, Spivak, McClelland & Maier

[57] ABSTRACT

A feed nozzle unit for a horizontal continuous casting process, the feed nozzle unit being disposed in coaxial relation between a tundish nozzle and a mold in a horizontal continuous casting device and including a fixing member of cylindrical form fixedly connected to the mold, the feed nozzle being fixed and connected in coaxial relation to the fixing member at a position inside a connecting side of the tundish nozzle, and the connecting refractory material being fitted in coaxial relation to the fixing member at a position adjacent a connecting side of the mold.

6 Claims, 6 Drawing Figures

STRUCTURE OF FEED NOZZLE UNIT FOR HORIZONTAL CONTINUOUS CASTING PROCESS

BACKGROUND OF THE INVENTION

1. Field of the Invention

The present invention relates to a feed nozzle unit disposed between a tundish nozzle and a mold in a horizontal continuous casting device, and more particularly to a unit in which assembly is simplified and resistance is increased against thermal and mechanical shock applied thereto during a continuous casting process.

2. Description of the Prior Art

FIG. 1 shows a longitudinal sectional view illustrating a principal part of a horizontal casting device as an example of the prior art. The casting device comprises a feed nozzle 1, a connecting refractory material 2 and a mold 3, connected in coaxial relation. The feed nozzle 1 is connected to a tundish nozzle 4 and molten metal M is transferred towards the mold 3, water flows through a water-cooling jacket 6 so as to cool the mold 3, and molten metal is solidified from outside and drawn intermittently to the arrow A direction so as to thereby perform continuous casting. In the figure, reference numeral 7 designates a feed nozzle assembly member and numeral 8 a fixing tool.

In such casting device, the feed nozzle 1 in itself is restricted in position by the assembling member 7 and fixed in coaxial relation with the mold 3 as shown in the figure. However, since the connecting refractory material 2 is only grasped between end surfaces of the feed nozzle 1 and the mold 3, centering of the refractory material 2 is considerably troublesome and difficult. Moreover no support member exists outside of the connecting refractory material 2 and therefore the refractory material 2 is liable to be broken by thermal shock or external mechanical force produced during the continuous casting process. As a result, molten metal penetrates the broken position and a fin is produced on the outer surface of a continuously cast strand (c.c. strand) such that the inner surface of the mold 3 may be damaged.

In order to eliminate the above-mentioned disadvantages, for example, a method as shown in FIG. 2 (being a longitudinal sectional view of a principal part) has been proposed. In the figure, taper machining is performed at connecting portions of the connecting refractory material 2 and the mold 3, respectively, but centering is not always easy to accomplish. Further, in order to prevent penetration of molten metal between the connecting refractory material and the mold, the tightening force between both members may be increased. However, if the tightening is performed excessively or without uniformity, breakage of the connecting refractory material 2 may be accelerated. The mold 3 and the feed nozzle 1 are tightened and fixed respectively by the assembling member 7 and the fixing tool 8 as above described. The tightening force, which attains a maximum value of 4000 kg, directly acts on the taper machining portion of the connecting refractory material 2 and compresses the refractory material 2 to decrease the diameter. The compressive force, which is uniform and suitable, acts to eliminate tension strain at the interior of the connecting refractory material produced during the casting and therefore is effective. However, uniform tightening is difficult in practical use and therefore local stres may be produced at the interior of the refractory material which may thus be broken.

In the connecting refractory material which is weak in resistance against thermal shock, a method as shown in FIG. 3 (being a longitudinal sectional view of a principal part) has been proposed. In this method, a reinforcing ring 9 is installed so as to shrinkage fit to the outside of the refractory material 2. This method is not at all effective as long as the above-mentioned centering remains possible. Moreover, the reinforcing ring 9 is loosened by heat transfer during the casting process and the effect of the shrinkage fit is lost. Therefore the effect is limited to a short time period during the initial stage of the casting.

SUMMARY OF THE INVENTION

In view of above-mentioned circumstances, the inventors have advanced the study of facilitating assembly of the connecting refractory material, particularly relating to centering and of preventing breakage of the refractory material based on thermal shock as much as possible. The present invention has been completed as a result of the study, and relates to the structure of a feed nozzle for horizontal continuous casting. The invention consists of a fixing member of short cylinder form and which is fixedly connected to a mold, a feed nozzle fixedly connected to the fixing member at an inner surface to a connecting side of a tundish nozzle, and a connecting refractory material fitted in coaxial relation to the fixing member and radially inside the fixing member.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

The constitution and working effect of the invention will now be described by way of examples referring to the accompanying drawings. Typical examples as hereinafter described do not restrict the invention, but suitable modification of specific structure of a feed nozzle, a connecting refractory material or a fixing tool of short cylinder form or connecting means to a mold within the spirit of the description shall be deemed to be included in the technical region of the invention.

Figure 1:
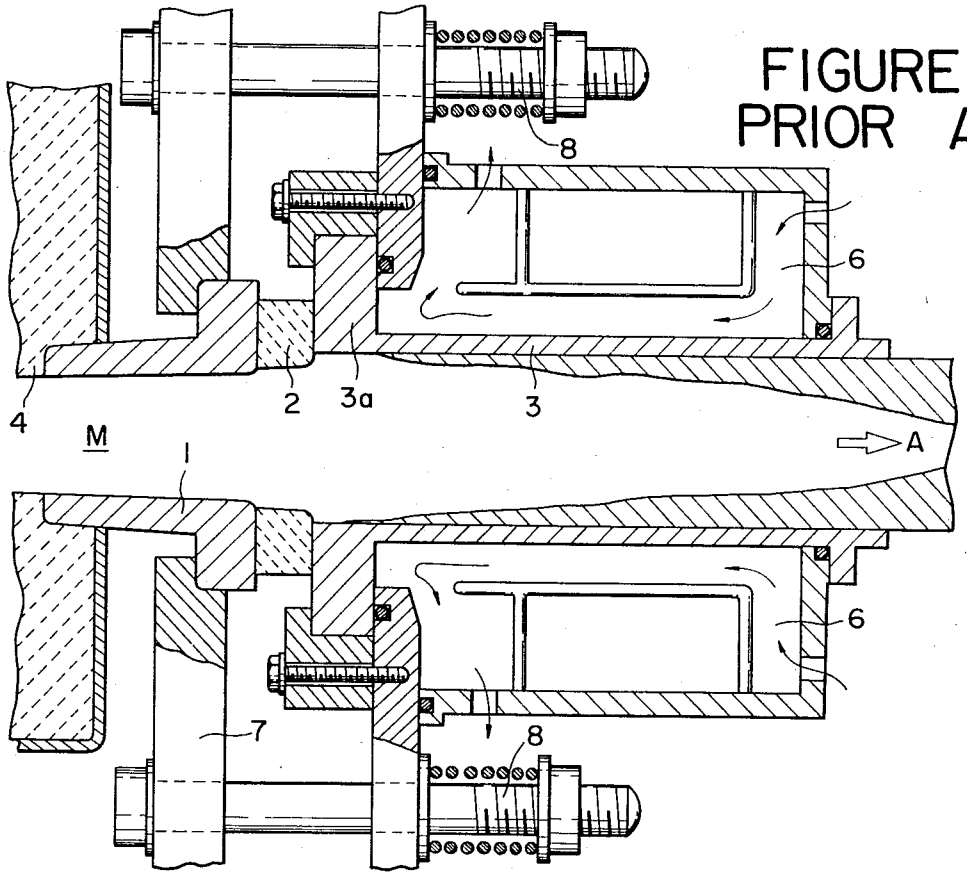
FIGURE 1 PRIOR ART
FIG. 1 is a longitudinal sectional view of principal part of a horizontal continuous casting device in accordance with the prior art.
Figure 2:
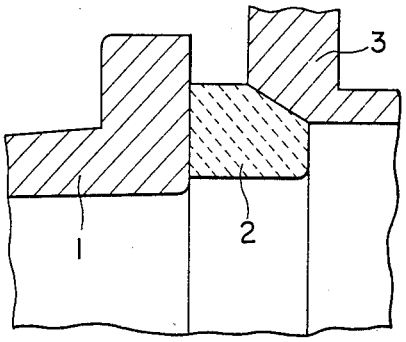
FIGURE 2 PRIOR ART
FIGS. 2 and 3 are sectional views illustrating connecting structure of a connecting refractory material of the prior art.
Figure 3:
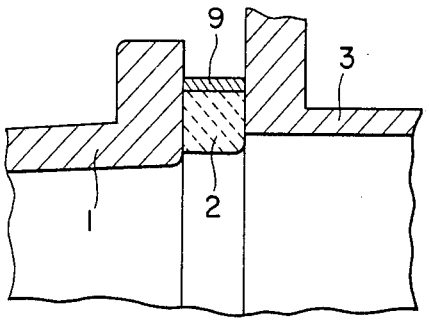
FIGURE 3 PRIOR ART
Figure 4:
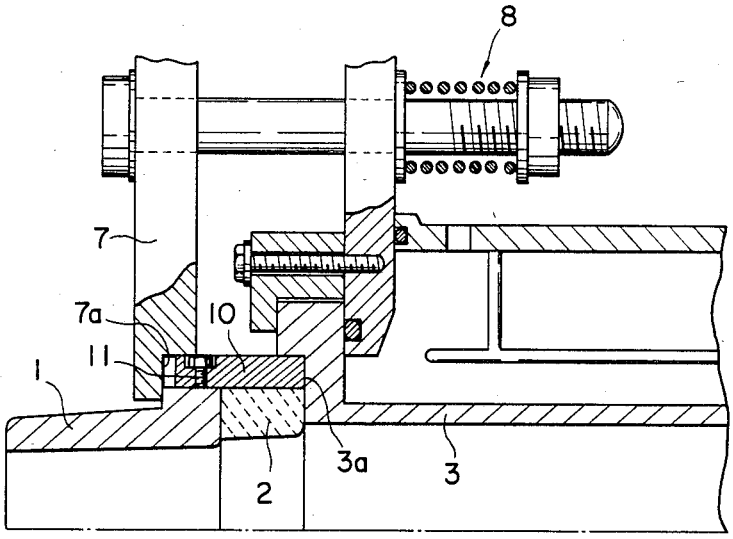
FIGS. 4 and 5 are longitudinal sectional views illustrating a principal part of the upper half of a mold to which a feed nozzle of the invention is applied.
Figure 5:
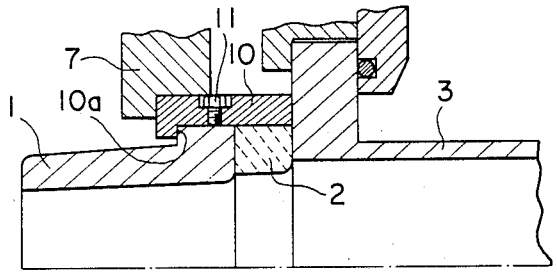

FIG. 4 shows a longitudinal sectional view of a principal part of the upper half of a horizontal continuous casting device to which structure of the feed nozzle as an embodiment of the invention is applied. In the figure, arrangement of a feed nozzle 1, a connecting refractory material 2 and a mold 3 are substantially identical to the conventional example shown in FIG. 1. In the present invention, however, a fixing member 10 of short cylinder form is fitted to the feed nozzle 1 radially outwardly of the connecting side to the connecting refractory material 2, and fixed in coaxial relation to the feed nozzle 1 by using a bolt 11 (or otherwise bonding by adhesive agent or threadably engagement), and the connecting refractory material 2 radially inside fixing member 10, thereby forming the feed nozzle member of the present invention. When the mold 3 is fixedly connected, the fixing member 10 and the end of the connecting refractory material 2 are engaged with a stepped portion 3*a* of the mold 3 at connecting portion to the nozzle and centering is performed. The other end of the feed nozzle is fitted to a stepped portion 7*a* at inside of the assembling member 7 and tightened and fixed by a fixing tool 8. Although the engaging stepped portion 3*a* is provided at a connecting side end portion of the mold 3 in the above-noted construction, since the fixing member 10 is positioned by the engaging stepped portion 7*a* provided on the assembling member 7 and centering with the mold 3 is performed, the engaging stepped portion 3*a* need not always be formed in the mold connecting end as seen in FIG. 5. Further, in this example, a stepped portion 10*a* is provided on the fixing member 10 at the connecting side of the feed nozzle 1 so as to fix the feed nozzle 1. In such constitution, since the connecting refractory material 2 is restricted in position by the inner circumferential surface of the fixing member, centering of the feed nozzle 1 and the mold 3 can be performed quite easily. Since the connecting refractory member 2 is engaged at its outer periphery by the fixing member 10, resistance against thermal shock and external mechanical force is significantly increased. Any material may be used for the fixing member 10 as long as it has a suitable density heat-resistant property. However, in order to prevent eccentricity of the connecting refractory material during casting and also prevent breakage caused by thermal shock, a material having small coefficient of thermal expansion is utilized. A typical example may be invar (36% Ni+Fe) or an incoloy alloy. The fixing member 10 performs centering and reinforcement of the connecting refractory material 2 simultaneously. In order to perform such function effectively, the difference between the inner diameter of the fixing member 10 and the outer diameter of the refractory material (i.e. gap between both members at fitted state) should be set less than approximately 0.3 mm, more preferably less than approximately 0.05 mm.

Figure 6:
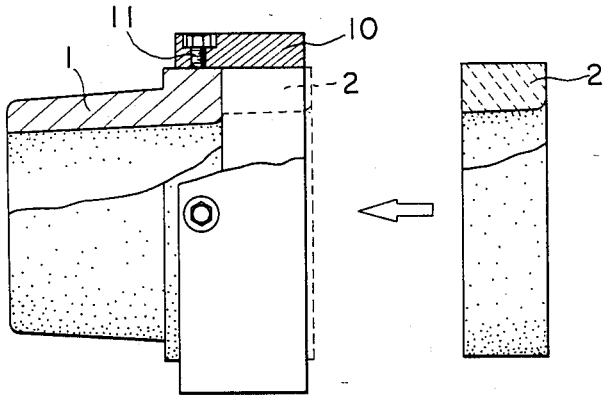
FIG. 6 is a side view partly cutaway of an example of the feed nozzle of the invention.

In the horizontal continuous casting device, the mold 3 is separated from the feed nozzle 1 and the connecting refractory material 2 after finishing one charge and is utilized a number of times. Since the feed nozzle 1 and the connecting refractory material 2 are significantly damaged, these are replaced by new ones for each charge. Therefore centering of the connecting refractory material 2 or the like must be performed for each charge. In the present invention, as seen in FIG. 6 (a side view partly cutaway) the nozzle member with the feed nozzle 1, the fixing member 10 and the connecting refractory material 2 assembled thereto may be prepared in advance, and be fixedly connected to the mold 3 in a cassette-type manner in a one-step operation. Thus, preparation for casting can be performed rapidly and easily.

The present invention is constituted as above described and has various advantages for practical uses as hereinafter described;

(1) Since a connecting refractory material is restricted in position by a fixing member of cylindrical form, centering with a mold can be performed automatically and simultaneously with assembly.

(2) Since the connecting refractory material is grasped and supported from its exterior by the fixing member, resistance against thermal shock and external mechanical force is elevated.

(3) Since the feed nozzle and connecting refractory material are securely fixed by the fixing member, a gap does not occur at the connecting portion and therefore damage to the mold caused by the formation of fin can be prevented.

(4) A nozzle unit may be prepared in cassette system, thereby simplifying assembly and allowing the preparation for casting to be performed rapidly.

What is claimed is:

1. A feed nozzle unit for a horizontal continuous casting device utilizing a mold, comprising:
   - a feed nozzle disposed in coaxial relation with said mold;
   - an assembly member having a stepped portion against which a portion of said feed nozzle abuts;
   - a cylindrical fixing member fixedly connected to said mold and positioned within said stepped portion of said assembly member, said feed nozzle being fixed to and connected in coaxial relation with said fixing member; and
   - a refractory member fitted radially within and in coaxial relation with said fixing member so as to interconnect said feed nozzle and said mold.

2. A feed nozzle unit as set forth in claim 1, wherein said fixing member and said refractory member form a gap therebetween, said gap being less than approximately 0.3 mm.

3. A feed nozzle unit as set forth in claim 1, wherein said gap is less than 0.05 mm.

4. A feed nozzle unit for a horizontal continuous casting device utilizing a mold, comprising:
   - a feed nozzle disposed in coaxial relation with said mold;
   - a cylindrical fixing member fixedly connected to said mold and positioned within said stepped portion of said assembly member, said feed nozzle being fixed to and connected in coaxial relation with said fixing member; and
   - a refractory member fitted radially within and in coaxial relation with said fixing member so as to interconnect said feed nozzle and said mold wherein said fixing member includes a stepped portion which engages with said feed nozzle so as to fix said feed nozzle in position against said refractory member.

5. A feed nozzle unit as set forth in claim 1, wherein said mold includes a stepped portion within which an end portion of said refractory member is positioned.

6. A feed nozzle unit for a horizontal continuous casting device utilizing a mold, comprising:
   - a feed nozzle disposed in coaxial relation with said mold;
   - a cylindrical fixing member fixedly connected to said mold and positioned within said stepped portion of said assembly member, said feed nozzle being fixed to and connected in coaxial relation with said fixing member; and a refractory member fitted radially within and in coaxial relation with said fixing member so as to interconnect said feed nozzle and said mold wherein said fixing member includes a stepped portion which engages with said feed nozzle so as to fix said feed nozzle in position against said refractory member and wherein said mold includes a stepped portion within which an end portion of said refractory member is positioned.

* * * * *